United States Patent [19]

Takahashi et al.

[11] 4,074,747

[45] Feb. 21, 1978

[54] CONTINUOUS CASTING MOLD FOR METALS

[75] Inventors: Hirohiko Takahashi, Tokyo; Yoshinao Otsuka, Toyama; Yuichiro Sato, Toyama; Yoshiki Tsukamoto, Toyama, all of Japan

[73] Assignee: Taiheiyo Kinzoku Kabushiki Kaisha, Tokyo, Japan

[21] Appl. No.: 715,657

[22] Filed: Aug. 19, 1976

[30] Foreign Application Priority Data

Oct. 21, 1975 Japan ..... 50-125904

[51] Int. Cl.[2] ..... B22D 11/04; B22C 1/00

[52] U.S. Cl. ..... 164/443; 164/138

[58] Field of Search ..... 164/23, 33, 88, 83, 164/82, 273 R, 283 M, 283 MS, 138

[56] References Cited

U.S. PATENT DOCUMENTS

| | | | |
|---|---|---|---|
| 2,136,394 | 11/1938 | Poland | 164/138 X |
| 3,098,269 | 7/1963 | Baier | 164/283 M |
| 3,210,812 | 10/1965 | Berwick | 164/273 R |
| 3,414,046 | 12/1968 | Pipitz | 164/273 R |
| 3,424,228 | 1/1969 | Warren | 164/273 R |

*Primary Examiner*—Francis S. Husar
*Assistant Examiner*—John S. Brown
*Attorney, Agent, or Firm*—Stevens, Davis, Miller & Mosher

[57] ABSTRACT

An open type casting mold suitably used for continuously casting metals having a large temperature difference between the melting point and the solidifying point thereof, said casting mold comprising a water-cooling jacket, a 1st stage die portion of other refractory material than graphite inserted in the mold at the inlet portion, said refractory material having a lubricating action with slight abrasion, and a 2nd stage die portion of graphite inserted in the mold at the outlet portion, said 1st stage die portion extending over the back end of the water-cooling jacket into a pouring basin side for a definite length.

Better results are obtained by covering the outer surface of the extended portion of the 1st stage die portion with a fixing member of a refractory material, fixing the fixing member of refractory material to the 1st stage die portion by means of a metallic protecting member, and fixing the metallic protecting member to the water-cooling jacket.

5 Claims, 1 Drawing Figure

CONTINUOUS CASTING MOLD FOR METALS

BACKGROUND OF THE INVENTION:

1. Field of the Invention

The present invention relates to a continuous casting mold for metals having a large difference between the melting temperature and the solidifying temperature thereof, such as white cast iron, high-alloyed special cast iron, high-speed tool steel, high-alloyed copper alloy, etc.

2. Description of the Prior Art:

A vertical type continuous casting method wherein a molten metal is directly poured in a water-cooling metal mold has generally been employed as a casting method which is applied to such metals that are reluctant to cause defects by quenching, such as ordinary steel, stainless steel, etc., and is suitable for mass production. On the other hand, a horizontal type continuous casting method wherein a graphite die is set in a water-cooling type cooler has been employed for casting such metals that have a comparatively low melting temperature and do not cause reaction with graphite in their molten states.

When a metal which is liable to cause a reaction with graphite is continuously cast using a graphite die, the portions of the graphite die which are brought into contact with the molten metal are eroded to greatly shorten the life of the graphite die and furthermore the casting operation is accompanied by the occurence of a sticking phenomenon upon solidification of the molten metal, causing rupture in a short period of time or making it difficult to draw the solidified metal from the die. Thus, such a casting method is not used for practical purposes. Moreover, it has been believed to be difficult to apply continuous casting to metals having a large difference between the melting temperature and the solidifying temperature thereof, such as, for example, white cast iron, high-alloyed special cast iron, high-speed tool steel, high cobalt-containing copper alloy, high chromium-containing copper alloy, high tin-containing copper alloy, etc., since in this case the solidified shell formed is weak and the molten metal is inferior in fluidity as compared with the case of using metals having a small difference between the melting temperature and the solidifying temperature.

SUMMARY OF THE INVENTION

A primary object of this invention is to provide an improved casting mold which can be applied for continuously casting of the afore-mentioned metals having a large difference between the melting temperature and the solidifying temperature without being accompanied by the above indicated difficulties. That is, according to the present invention, there is provided a continuous casting mold for metals having a large difference between the melting temperature and the solidifying temperature, said casting mold having inserted therein, at the portion thereof which is brought into contact with the molten metal, a 1st stage die portion of other refractory material than graphite of a definite length, by using of said refractory material showing a lubricating action with slight abrasion to be able to prevent the occurence of the sticking phenomenon by the molten metal at the contact portion of the die and the molten metal and to enable continuous casting of the metal for a long period of time.

Also, according to another embodiment of the present invention, there is provided an improved continuous casting mold for metals having a large difference between the melting temperature and the solidifying temperature thereof, which can be continuously used for casting these metals with a high durability for a long period of time, said casting mold having inserted therein, at the portion thereof which is brought into contact with the molten metal, a 1st stage die portion of other refractory material than graphite in a definite length, said refractory material showing a lubricating action with slight abrasion, said 1st die portion of the refractory material having covered thereover a refractory member and a metallic protecting member at the portion thereof projected in a pouring basin wherein said 1st stage die is brought into contact with the molten metal, and said metallic protecting member being further fixed to a water-cooling jacket to prevent the occurence of the breakage of the projected portion of the 1st stage die in the basin.

Figure 1:
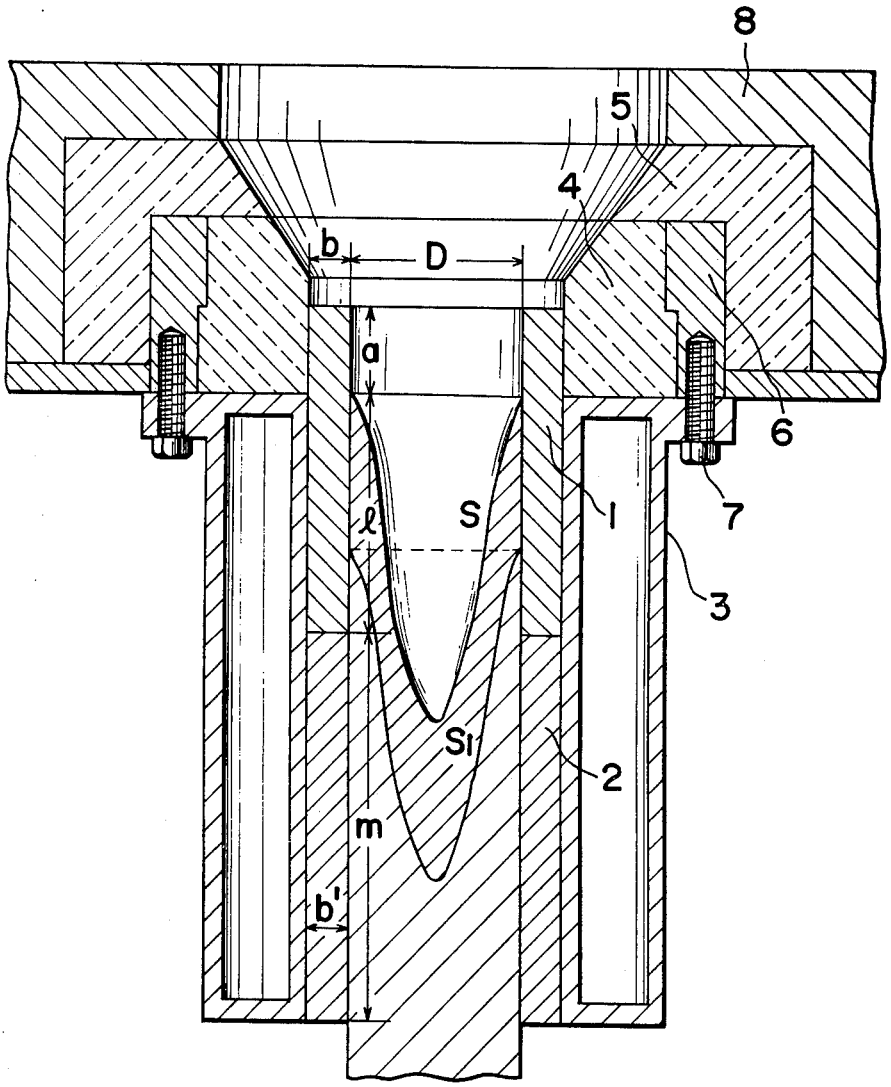
FIG. 1 is a schematic cross sectional view showing an embodiment of the continuous casting mold of this invention.

DETAILED DESCRIPTION OF THE INVENTION:

In the continuous casting mold of this invention, the 1st stage die portion which is brought into contact with a molten metal is made of other refractory material than graphite, which shows a lubricating action accompanied by the occurence of slight abrasion, and in this case better results are obtained when a metal nitride, metal boride and composite of these materials are used as such refractory materials. That is, since said refractory materials are not generally wetted by a molten metal and show excellent lubricating action with slight abrasion, the solidified ingot can be drawn at a low drawing force and thus the rupture of the solidified shell of the metal does not occur.

Accordingly, in the case of continuously casting a molten metal which causes reaction with graphite, graphite having an inside diameter the same as that of the 1st stage die portion, a hardness the same as or lower than that of the refractory material for the 1st stage die portion is used safely as the material for a 2nd stage die portion at the outlet side of the mold in this invention.

It is known that horizontal-type continuous casting can produce continuously cast metal products having excellent quality. However, a meandering phenomenon of the continuously cast material occurs owing to ununiform local cooling of the continuously cast material in the mold which results in giving a bending force to the casting die and, as the case may be, breaking the die.

In the present invention, however, for preventing the occurence of the breakage of the casting die by the meandering action of the continuously cast material, the 1st stage die portion of the refractory material is covered by a fixing ring of a refractory material at the portion thereof extending or projecting over the back end of a water-cooling jacket into a pouring basin, the fixing ring is fixed onto the 1st stage die portion by means of a metallic protecting member, and further the metallic protecting member is fixed strongly to the end of the water-cooling jacket by mechanical means. That is, in the continuous casting mold of this invention, the 1st stage die of a refractory material, the 2nd stage die of graphite type refractory material, the water-cooling jacket, the fixing member of a refractory material, and the metallic protecting member are rigidly combined to prevent the casting die from being broken by the meandering action of the continuously cast material.

The metals having a large temperature difference between the melting point and the solidifying point thereof, such as white cast iron, Fe-C-Cr alloy, Fe-C-W alloy, Fe-C-Mo alloy, Fe-C-Ti alloy, Cu-Cr alloy, Cu-Co alloy, Cu-Sn alloy, etc., are believed to be unsuitable for continuous casting as stated before and in the case of casting the aforesaid metals having, in particular, a temperature difference over 100° C. between the melting point and the solidifying point that exist in a chemical composition of forming an eutectic reaction, it is difficult to perform stably the continuous casting of these metals using a conventional casting mold, since in such a case the solidified shell of the metal formed is comparatively weak and thus is readily broken by the force induced from the force required for drawing the solidified metal and the force formed by the friction between the drawing metal and the die. Furthermore, in connection with the quality of the cast products, the products obtained in a conventional manner are greatly inferior in surface quality as well as inside quality owing to the poor fluidity of the molten metals in the temperature range at which the metals are in the molten state.

On the other hand, in order to overcome the above disadvantagees, the continuous casting mold of this invention has such a feature that the casting mold comprises a 1st stage die portion of other refractory material than graphite, said refractory material showing a lubricating action with slight abrasion, said 1st stage die portion having a length longer than one drawing length and being inserted in the mold at the runner or inlet side thereof, said 1st stage die portion of the refractory material being projected, at the runner or inlet side of the mold, over the back end of the water-cooling jacket into a pouring basin for a length of longer than the thickness of the 1st stage die portion, and a 2nd die portion of the graphite type refractory material inserted in the mold at the front side of the 1st stage die portion for a length of 1-4 times the length of the 1st stage die portion of the refractory material. Being thus configurated, the casting mold of this invention is effective for continuous casting of metals having a large difference between the melting temperture and the solidifying temperature thereof and can produce continuously cast metals having excellent quality for a long period of time.

Now, the invention will further be explained in more detail by referring to FIG. 1 of the accompanying drawing which shows an embodiment of the continuous casting mold of this invention.

As shown in the figure, a 1st stage refractory material die 1 having a cross sectional size D and a graphite type refractory material die 2 are inserted in a water-cooling jacket 3 and the runner side end of the 1st stage die 1 extends over the back side of the water-cooling jacket 3 and is disposed at the inside wall of the fixing refractory material or fixing brick 4. The fixing brick 4 is fixed to the 1st stage die 1 by means of a metallic protecting member 6 and is further fixed to the water-cooling jacket 3 by means of clamping bolts 7. The outermost member, the metallic protecting member 6 of the casting mold comprising, as illustrated above, the 1st stage refractory material die 1, the 2nd stage refractory material die 2, the water-cooling jacket 3, the fixing brick 4, and the metallic protecting member 6 is inserted watertightly in a bonding brick 5 of a molten metal-retaining furnace 8.

The solidification of ingot begins at the inside surface of the 1st stage refractory die 1 and at about the contact position of the fixing refractory material 4 and the water-cooling jacket 3. In an intermittent drawing operation of casting, the position of the section S of a solidified shell of metal grown during the intermitted period of drawing shifts to a position S′ by subsequent drawing as shown in the figure and since the edge of the shell S′ is always positioned in the 1st stage refractory die 1, the molten metal is not brought into contact with the 2nd stage refractory die 2. The solidification of the molten metal having the front solidified shell at the position S′ grows to the position S during the intermitted period of drawing. The length of the 1st stage refractory die 1 is required to be a length $l$ of the contact section between the 1st refractory die 1 and the water-cooling jacket 3 plus a length $a$ of the projected portion of the die 1 since it is required that the 1st stage refractory die 1 extends in the molten metal side over the edge position of the solidified shell S directly before drawing. It is further required that the length $l$ be longer than the one drawing length or be suitably 1–5 times the length of one drawing but it is not required that the length be excessively longer. The one drawing length means the distance travelled by the drawing apparatus during the time from a stopped state to the next state. It is also required that the length $a$ of the projected portion of the 1st stage die 1 be the same as or longer than the thickness $b$ of the 1st stage die 1. If the length $a$ of the projected portion of the 1st stage die 1 is shorter than the thickness $b$ of the same die, the solidification of the molten metal comes up to the front end of the 1st stage refractory die 1 to cause the increase of drawing resistance and to cause the abrasion or breakage of the 1st stage refractory die 1 at the front end portion thereof as well as to cause the rupture of the solidified shell of metal and the occurence of the sticking out phenomenon, which result in the occurence of the sticking out phenomenon, which result in the occurence of breaking out or making it difficult to draw further the solidified metal. It is not required that the length $a$ of the projected portion be excessively longer. Thickness $b$ of the 1st stage refractory die 1 is suitably 5–20 cm. If the thickness of the die is thicker than the above range, the cooling rate of the molten metal is lowered to reduce the productivity of cast products, while if the thickness is thinner than the aforesaid value, the die cannot be used for a long period of time due to the occurence of severe abrasion. It is required that the length $m$ of the graphite die 2 be 1–4 times the length $l$ of the die 1. If the length of the graphite die 2 is shorter than the above value, a sufficient cooling effect is not obtained, while if the length is longer than the aforesaid value, the drawing resistance increases to shorten the life of the die. Furthermore, the thickness $b'$ of the 2nd stage graphite die 2 is not necessarily the same as the thickness $b$ of the 1st stage refractory die 1 but if the thickness $b'$ is much thinner than the thickness $b$, the life of the die 1 is shortened by the occurence of severe abrasion, while if the thickness $b'$ is much thicker than the thickness $b$, the cooling rate of the molten metal is reduced.

In continuous casting of metals, it often happens that the surface of the continuously cast material is liable to be ununiformly cooled to cause ununiform local cooling of the cast material, which inevitably results in causing a meandering phenomenon of the continuously cast material. The meandering phenomenon of the cast material induces a bending force or action to the casting mold and if the base portion of the projected part of a refractory die 1 of the casting mold is not protected, the base portion is frequently broken, which makes it difficult to further continue the casting operation. This difficulty can be completely overcome by covering the base portion of the projected part of the 1st stage refractory die 1 by a fixing refractory material 4 fixed thereto by means of a metallic protecting member 6 which is also fixed to a water-cooling jacket 3 by clamping bolts 7.

Then, the effects or merits of this invention will be explained by the following examples.

EXAMPLE 1

Kind of molten metal: Alloyed white cast iron.

Main chemical compositions of the cast iron:

2.5% C, 0.5% Si, 0.5% Mn, and 2.5% Cr. Difference between melting temperature and solidifying temperature: 178° C. (1,301° C. - 1,123° C.).

Size of each part of metal nitride die:

$a$ = 15 mm., $b$ = 10 mm., $l$ = 100 mm., and $D$ = 60 mm.$\phi$.

Size of each part of graphite die:

$b'$ = 8 mm., $m$ = 200 mm., and D = 60 mm.$\phi$.

By carrying out continuous casting of the metal with one drawing length of 50 mm. using the continuous casting mold of this invention as illustrated in FIG. 1 under the conditions described above, 35,050 kg. of the white cast iron product could be continuously drawn during the drawing period of 123 hours and 30 minutes. The cast product was a round metal article having a mean diameter of 60.5 mm.

EXAMPLE 2

Kind of molten metal: 13% Cr steel.

Main chemical compositions of the steel:

1.2% C, 0.5% Si, 0.6% Mn, and 13% Cr.

Difference between melting temperature and solidifying temperature: 230° C. (1,430° C. - 1,200° C.).

Size of each part of metal nitride die:

$a$ = 30 mm., $b$ = 15 mm., $l$ = 150 mm., and D = 40 mm x 350 mm.

Size of each part of graphite die:

$b$ = 15 mm., $m$ = 300 mm., and D = 40 mm. x 350 mm.

By carrying out continuous casting of the metal with one drawing length of 70 mm. using the continuous casting mold of this invention as illustrated in FIG. 1 under the conditions described above, 32,800 kg. of the cast metal product could be continuously drawn during the drawing period of 97 hours and 50 minutes. The product obtained had a mean thickness of 42 mm. and a mean width of 352 mm.

EXAMPLE 3

Kind of molten metal: 24 Cr cast iron.

Main chemical compositions of the cast iron: 2.3% C, 0.5% Si, 0.6% Mn, and 24% Cr.

Difference between melting temperature and solidifying temperature: 120° C. (1,330° C. - 1,210° C.).

Size of each part of metal nitride die:

$a$ = 25 mm., $b$ = 15 mm., $l$ = 160 mm., and D = 80 mm.$\phi$.

Size of each part of graphite die:

$b'$ = 15 mm., $m$ = 250 mm., and D = 80 mm.$\phi$.

By carrying out continuous casting of the metal with one drawing length of 60 mm. using the casting mold of this invention as illustrated in FIG. 1 under the conditions shown above, 28,200 kg. of the cast iron product could continuously be drawn during the drawing period of 75 hours and 30 minutes. The product obtained was a square article having a mean dimension of 80 mm.

EXAMPLE 4

Kind of molten metal: High Cr copper alloy.

Main chemical components of the alloy:

25% Cr and 75% Cu.

Difference between melting temperature and solidifying temperature: 324° C. (1,400° C.).

Size of each part of metal nitride die:

$a$ = 35 mm., $b$ = 18 mm., $l$ = 180 mm., and D = 90 mm.$\phi$.

Size of each part of graphite die:

$b'$ = 18 mm., $m$ = 250 mm., and D = 90 mm.$\phi$.

By carrying out continuous casting of the metal with one drawing length of 80 mm. using the casting mold of this invention as illustrated in FIG. 1 under the above conditions, 52,800 kg. of the cast product could be continuously drawn during the drawing period of 148 hours and 35 minutes. The product obtained was a square article having a mean dimension of 92 mm.

EXAMPLE 5

Kind of molten metal: Gray cast iron.

Main chemical components of the metal:

3.2% C, 1.8% Si, and 0.5% Mn.

Difference between melting temperature and solidifying temperature: 137° C. (1,260° C. - 1,123° C.).

Size of each part of metal nitride die:

$a$ = 25 mm., $b$ = 15 mm., $l$ = 160 mm., and D = 80 mm.$\phi$.

Size of each part of graphite die:

$b'$ = 15 mm., $m$ = 250 mm., and D = 80 mm.$\phi$.

By carrying out continuous casting of the metal with one drawing length of 75 mm. using the casting mold of this invention as illustrated in FIG. 1 under the above conditions, 95,190 kg. of the cast product was continuously drawn during the drawing period of 167 hours and 20 minutes. The product obtained was a square article having a mean dimension of 82.5 mm.

In addition, when the same procedure as above was followed using a conventional graphite type mold, only 7,500 kg. of cast product was obtained during the period of 12 hours and 50 minutes. Thus, from these results, it will be understood that the continuous casting mold of this invention is very excellent as compared with conventional graphite type casting mold.

The features and merits of this invention described above in detail are all concerned with a horizontal type continuous casting mold but it will be understood by those skilled in the art that almost same result will be obtained when the invention is applied to other types of continuous casting molds such as, for example, a vertical type or slant type continuous casting mold.

We claim:

1. A continuous casting mold for metals having a large difference between the melting temperature and the solidifying temperature thereof, said casting mold being an open mold having an inlet end and an outlet end and said inlet end being directly connected to a pouring basin, comprising a 1st stage die portion of refractory material other than graphite, a 2nd stage die portion of a graphite type refractory material, and a water-cooling jacket, said 1st stage die portion being in the water-cooling jacket at the inlet side for a length longer than one drawing length and said 1st stage die portion in the water-cooling jacket at the inlet side extending beyond the back end of said water-cooling jacket into the pouring basin side for a length longer than the thickness of said 1st stage die portion, and said 2nd stage die portion being in the mold at the outlet side thereof and having a length of 1–4 times the length of said 1st stage die portion.

2. The continuous casting mold as claimed in claim 1 wherein said refractory material for the 1st stage die portion is a metal nitride, metal boride and composite of these materials.

3. The continuous casting mold as claimed in claim 1 wherein the outer surface of the 1st stage die portion is covered by a fixing member of a refractory material at the extended portion in the pouring basin side.

4. The continuous casting mold as claimed in claim 1 wherein the outer surface of the 1st stage die portion is covered by a fixing member of a refractory material at the extended portion in the pouring basin side and said fixing member is fixed to the 1st stage die portion by means of a metallic protecting member, said metallic protecting member being further fixed to the water-cooling jacket.

5. An open continuous casting mold for metals having a difference of over 100° C between the melting temperature and the solidifying temperature thereof, said mold having an inlet end and an outlet end and comprising:

a pouring basin at the inlet end thereof;

means defining a cooling jacket extending from one end at said basin to the other end thereof at the outlet end of the mold;

a first die portion of refractory material other than graphite, said first die portion extending from one end thereof at least partly coextensive with said basin for a length longer than the thickness thereof into said cooling jacket for a length longer than one drawing length to the other end thereof; and a second die portion of a graphite type refractory material in said cooling jacket, said second die portion extending from the other end of said first die portion toward the outlet end of the mold and having a length of between one and four times the length of the first die portion.

* * * * *